US005090315A

United States Patent [19]

Lee et al.

[11] Patent Number: 5,090,315

[45] Date of Patent: Feb. 25, 1992

[54] ELECTRONICALLY CONTROLLABLE INK FOUNTAIN ROLL DRIVE SYSTEM, AND METHOD

[75] Inventors: Sung C. Lee, Bridgeport; James N. Crum, Stonington, both of Conn.

[73] Assignee: Man Roland Druckmaschinen AG, Offenbach am Main, Fed. Rep. of Germany

[21] Appl. No.: 714,916

[22] Filed: Jun. 13, 1991

[51] Int. Cl.[5] ..... B41L 25/00

[52] U.S. Cl. ..... 101/148; 101/350; 101/351; 101/364; 101/DIG. 32

[58] Field of Search ..... 101/147, 148, 349, 350, 101/351, 352, 363, 364, 365, DIG. 32, 483, 484, 485, 367

[56] References Cited

U.S. PATENT DOCUMENTS

| | | | |
|---|---|---|---|
| 3,688,696 | 9/1972 | Treff | 101/148 |
| 4,157,682 | 6/1979 | Mabrouk et al. | 101/148 |
| 4,570,539 | 2/1986 | Rottstedt | 101/483 |
| 4,896,602 | 1/1990 | Jenh et al. | 101/350 |
| 5,031,535 | 7/1991 | Kipphan | 101/350 |

FOREIGN PATENT DOCUMENTS

| | | |
|---|---|---|
| 1188616 | 3/1965 | Fed. Rep. of Germany . |
| 2945894 | 5/1981 | Fed. Rep. of Germany . |
| 3716679 | 7/1988 | Fed. Rep. of Germany . |

*Primary Examiner*—Edgar S. Burr
*Assistant Examiner*—Joseph R. Keating
*Attorney, Agent, or Firm*—Frishauf, Holtz, Goodman & Woodward

[57] ABSTRACT

A low-inertia, fast-acting servo motor (40) coupled through a gear to a fountain roll (20) of an inker is controlled and energized by an electronic control unit (45). The control unit controls acceleration of the fountain roll (20) during the period of time when a ductor roller (21) is in contact therewith, from speed 0 to the required speed which is necessary to rotate the fountain roll (20) about a predetermined angle ($\phi s$) which, for example, is between 0° and 90°. During the second half of the ductor roller cycle (T), that is, when the ductor roller (21) is separated from the fountain roll (20) and in engagement with an ink transfer roller (22) of the inker, the angular speed of the fountain roll is braked to zero speed. The system permits remote command of the angle of rotation ($\phi s$) of the fountain roll (20) during the half cycle (T/2) of the ductor roller (21) as the ductor roller oscillates at a speed depending on printing press machine speed. The rotation of the freely rotatable ductor roller (21) imparted thereto by the ink transfer roller (22) assists in accelerating the fountain roll (20). The closed servo loops ensure operation of the system, as commanded.

12 Claims, 2 Drawing Sheets

ELECTRONICALLY CONTROLLABLE INK FOUNTAIN ROLL DRIVE SYSTEM, AND METHOD

FIELD OF THE INVENTION

The present invention relates to printing machinery, and more particularly to a drive system for an ink fountain roll which is versatile, smaller and cheaper than prior art apparatus, and lends itself to incorporation in existing printing machines, that is, to retrofit existing printing machines with the roll drive system in accordance with the present invention, and to a simplified drive method.

BACKGROUND

Printing presses, and particularly web fed lithographic offset printing presses, typically employ a steel fountain roll which turns in a reservoir of ink. A flexible or segmented doctor blade presses against this roll, with adjustable, controllable pressure, for example in different zones, to control the thickness of the ink film acquired by the roll as it dips into an ink trough or reservoir. Blade adjustment screws, or similar devices, permit control of the thickness of the ink film picked up by the fountain roll to be varied across the width of the press in order to fit selected print requirements across the width of the substrate on which printing is to be carried out.

The ink train itself includes a plurality of rollers or cylinders, some of which may oscillate axially. Ink is transferred from the fountain roll to the ink train in accordance with the system to which the present invention relates by a free-turning ductor roller, which oscillates back and forth between the fountain roll and the first ink transfer roll of the ink train. The ductor is moved by a mechanical drive, energized by the gear train of the printing press, to engage, alternately, with the fountain roll and the first ink transfer roll or roller of the ink train.

The amount of ink delivered to the ink train by the ductor roller depends on the degree of angular advancement of the fountain roll during the time that the ductor roller is in contact with the fountain roll, as well as on the thickness of the ink across the axial length of the fountain roll, and hence of the ductor roller. In some presses, the fountain roll turns continuously; a variable speed drive is provided, the variable speed drive changing speed as a function of and in dependence on the operating speed of the printing press. In addition, the speed ratio between the fountain roll and the press speed can be changed, to thereby vary the amount of ink being transferred, by changing the angle of rotation of the fountain roll during which the ductor roller is in contact therewith.

Ink is distributed from the first ink transfer roller through an array of ink distribution rollers to the plate cylinder of the printing machine. The ink, after inking the plate, is then offset on a blanket cylinder for printing on a substrate web, typically paper. If the paper has the characteristic that it can shed fibers, fluff or lint, such fibers, fluff or lint can be transferred back to the ink supply through the various ink distribution rollers and, eventually, can reach the ink reservoir or ink trough via the intermittently operatating or oscillating ductor roller. Fluff, lint, dust or other contaminants can then collect within the ink trough which, over time, can cause changes in the amount of ink being transferred.

To overcome the problem of change in ink transfer due to accumulation of contaminants in the ink trough, it has been proposed to rotate the fountain roll only during the time that the ductor roller is in contact with it. This intermittent motion, it has been found, prevents build-up of contaminants in selected regions of the ink trough, and hence on the fountain roller, which may cause striping or lines on the eventual image being printed. Intermittent motion of the fountain roller, in the past, has been obtained by various mechanisms, for example by an adjustable-length crank mechanism driven by the press, a gear train which includes gearing with gaps along the circumference for intermittent operation and which, even, permits reverse rotation of the fountain roller (see German Patent 37 16 679, Nawrath) or by a Maltese cross drive (see German Published Application 5 1 188 616, Norlin).

The inkers as known utilize the time during which the ductor roller is out-of-contact with the fountain roller as a dead or stop time for the fountain roller; thus, the fountain roller is driven only during the interval of engagement or contact with the ductor roller. This intermittent movement has been found to prevent accumulation of contaminants between the ink film control elements, typically doctor blades or doctor blade elements, and the fountain roller.

The apparatus to ensure intermittent operation of the rollers is complex and expensive, and causes maintenance problems.

THE INVENTION

It is an object to improve an intermittent ink fountain roller drive so that it can be easily controlled to provide selected angles of rotation during the time that the fountain roll is in engagement with a ductor roller, and which, additionally, permits ready variation of rotational speed and direction, while being simple, cheaper, and not requiring complex drive systems, and to a simple method of operating the fountain roll.

Briefly, the fountain roll is driven by an electric high-torque servo motor which is controlled by a servo amplifier and a controller which receives inputs from operator controllable commands and press data. The controller controls intermittent operation of the motor. A sensor, for example a Hall element transducer, is coupled to the ductor roller to provide a ductor position signal representative of the start of a ductor roller cycle, for example upon shift of position of the ductor roller towards engagement with the fountain roll. The control unit has input terminals which are coupled to the controller, preferably an electronic controller, to receive a printing machine speed signal, representative of the operationg speed of the printing machine. The ductor roller cycling time is a function of press speed. A second input to the electronic control unit is operator controlled, that is, a signal representative of the desired angle of rotation of the fountain roll during which the ductor roller is in engagement with the fountain roll. The control unit has a third input to which the ductor position signal is coupled. This ductor position signal, in effect, provides a start signal—duly amplified—for the servo motor to begin rotation of the fountain roll. The fountain roll is driven at a speed such that, during the contact engagement time with the ductor roller, the fountain roll 20 will rotate over an angle which is determined by the operator selected and controlled angle $\phi$.

The system has the advantage that it permits control of the amount of ink being transferred, by varying the angle of engagement of rotation of the fountain roll during the time that the ductor roller is in contact with it by varying the speed of the fountain roll , electronically. Thus, a press operator can control the amount of ink being transferred merely by changing a setting of a manually operable control on the printing machine control console which, in turn, will change the rotary speed of the fountain roll, and hence the angle over which the fountain roll will turn during the time the ductor roller is in engagement therewith.

A modern high-speed web-fed printing machine may operate at a press speed of, for example, about 2,500 feet per minute, which is approximately 815 meters per minute or about 14 meters per second. At such a printing machine speed, the ductor cycle is 0.266 seconds. The ductor is in contact with the fountain roll for half this cycling period, or about 133 milliseconds. During this time, the fountain roll must be accelerated from zero speed to that speed required to achieve the commanded advancement angle, or rotational angle, as controlled by the operator. This angle can be set by the press operator between 0° and 90° to suit printing requirements. It is usually commanded in form of percentage of rotary angle, in which a rotation of the fountain roll over 90° corresponds to 100% inking. During the second half of the ductor cycle, the fountain roll must be decelerated to zero speed. The speed vs. time profile is not critical; the advancement angle set by the press operator, however, is critical and must be achieved at the time when the ductor again leaves the fountain roll.

The system has the additional advantage that it is not only possible to vary the rotary angle of the fountain roll during engagement with the ductor roller under operator command, but also to vary, for example, the repetition sequences of fountain roll operation. By either software or simple hardware modification, it is easily possible to allow the fountain roll, for example, to run continuously for a given number of ductor cycles and then produce one or more intermittent cycles, as required, to clear lint. This type of operation reduces the amount of servo motor heating as well as the amount of wear on gearing interposed between the servo motor and the fountain roll.

DRAWINGS

DETAILED DESCRIPTION

Figure 1:
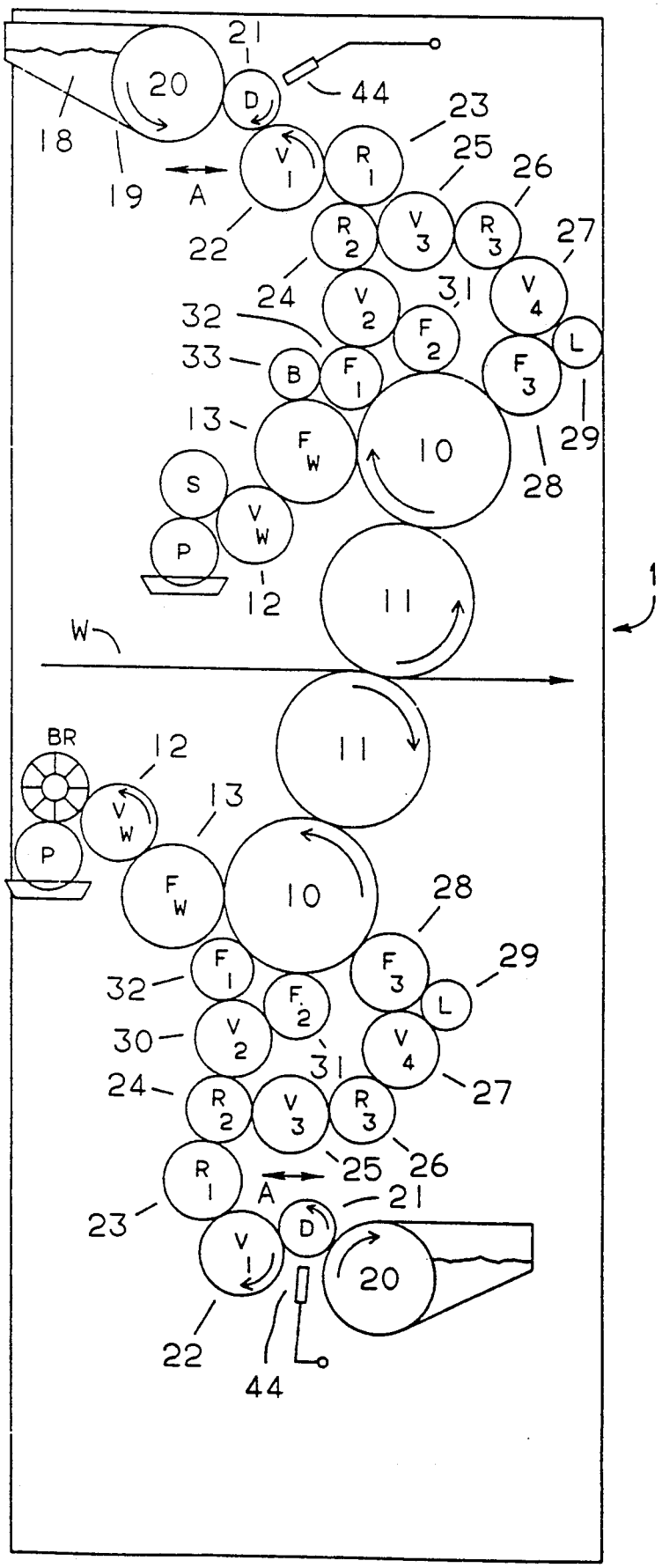
FIG. 1 is a side view of a perfecting type printing machine station having an inker with an oscillating ductor roller.

FIG. 1 is a highly schematic representation of a web-fed rotary offset printing machine. The machine is illustrated for perfecting printing. Since, functionally, the printing systems printing on the prime and verso side, respectively, of the web W are functionally identical, the respective elements will be given the same reference numerals or letters, distinguished merely by prime notation for the lower unit.

Each printing system has a plate cylinder 10 , in ink transferring relationship with a blanket or offset cylinder 11. Damping fluid, in accordance with well known lithographic printing is provided by a damper having a damping liquid pick-up roller P, a slip roller S or its functional equivalent, a brush roller BR, respectively, which transfers damping liquid to a first transfer roller 12, which, in turn, is applied on an application roller 13. The inker has an ink fountain roll 20, positioned in ink transferring engagement within an ink trough 18. The thickness of the ink film is controlled by engagement of a doctor blade 19 with the circumference of the fountain roll 20. The engagement conditions of the doctor blade against the fountain roll 20 can be varied over the axial length of the fountain roll, in accordance with well known blade adjustment systems, not shown, because they can be of any suitable construction.

A ductor roller 21 transfers ink from the fountain roll 20 to an ink train, which includes a plurality of rollers or cylinders, some of which may be axially oscillating or vibrating. The ductor roller 21 first transfers ink from the fountain roll 20 to a first ink transfer roller 22 which, in turn, is in surface engagement with and transfers ink to a second transfer roller 23 and from there to a third transfer roller 24. The ink film on roller 24 is then split and transferred to a first sub-train including vibrator roller 25, transfer roller 26, a further vibrating roller 27, and an ink application roller 28. A roller 29 can be placed in engagement with the ink application roller 28. A second path of the ink train passes through a vibrating roller 30 and then to two application rollers 31, 32. The upper ink train may have an additional coupling roller 33 in engagement with both the damping liquid application roller 13 and the ink application roller 32. A similar roller can also be placed in the lower system, if required.

The directions of rotation of the plate cylinder 10, the blanket cylinder 11, the fountain roll 20, ductor roller 21 and first ink transfer roller 22 are indicated by the arrows in the drawing.

The ductor roller 21 oscillates back and forth between engagement with the fountain roll 20 and the ink transfer roller 22, as schematically shown by the double arrow A, as well known in ductor-type inkers. Any system may be used, and since the apparatus to place the ductor roller, selectively, intermittently alternately in engagement with the fountain roll 20 or the first ink transfer roll 22 is well known, it has been omitted from the drawing for simplicity. In a suitable system, a cam is used to control the position as well as the dwell time of the ductor roller 21 in engagement with, respectively, the fountain roll 20 or the first ink transfer roll 22. This cam is rotationally coupled to the printing machine operating drive and, hence, rotates at a speed which is dependent on and representative of printing machine operating speed. Thus, the time of engagement of the ductor roller with, respectively, the fountain roll 20 or the transfer roller or cylinder 22, is dependent on printing machine operating speed.

In accordance with a feature of the invention, the fountain roll 20 is driven at a speed which is independent of the machine speed but has a definite relationship thereto, since the angle over which the fountain roll 20 rotates during the time that the ductor roller 21 is in engagement therewith can be operator controlled.

The inker rollers, and specifically inker rollers 22, 23, 24, 25, are driven at machine speed. The ductor roller 21 is freely rotatable. When the ductor roller 21 is in engagement with the first ink roller 22, that is, the first transfer roller, the ductor roller, due to the friction of the ink thereon as well as of the ink on the transfer roller 22, will be carried along frictionally, and at the end of engagement of the ductor roller 21, will have reached at least approximately the speed of the transfer roller 22. During the very short period of time it takes to come in engagement with the fountain roll 20, it will decelerate due to friction, and match the speed of the fountain roll. The fountain roll 20 must be accelerated from, effectively, standstill to the required speed to rotate over an angle as commanded by the press operator during the time that the ductor roller 21 is in contact therewith. The initial acceleration of the fountain roll 20, under electric motor drive, as will appear below, is assisted by the transfer of rotary energy to the fountain roll 20 due to the rotation of the ductor roller 21 which had been imparted thereto by the machine drive when it was in engagement with the transfer roller 22.

Figure 2:
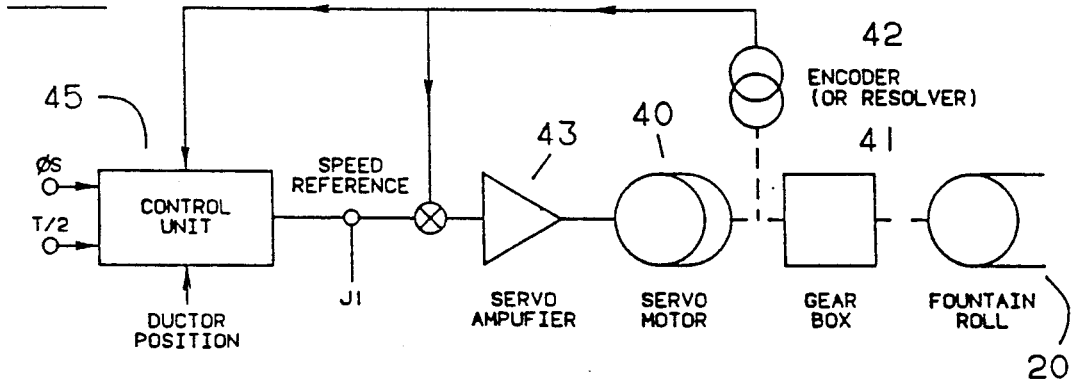
FIG. 2 is a schematic diagram of the system and control of the fountain roll drive motor.

Referring now to FIG. 2:

In accordance with a feature of the invention, the fountain roll 20 is driven by a servo motor 40 through a reduction gear box 41. The shaft of the servo motor is coupled to an encoder or resolver 42, providing a pulse output signal, representative of the instantaneous speed of the fountain roll 20. This signal is integrated in a press controller 45 thus providing a measure of the fountain advancement angle.

The press controller , in a preferred embodiment, is an electronic controller, forming part, or all of a control unit 45. Unit 45 has its own internal clock. Unit 45 receives three input signals which command or control its operation. A first input signal is the signal representative of the time during which the ductor roller 21 is in contact with a fountain roller, that is, one-half of the cycling time T of the ductor roller 21. This signal is the T/2 signal. Since the ductor roller oscillating mechanism is coupled to the printing machine, this signal will also be representative of printing press machine speed.

Unit 45 receives a second input signal, representative of the angle $\phi s$, which is the angle of rotation through which fountain roll 20 is to rotate during the time T/2, as commanded by the press operator. In accordance with one printing machine system, a $\phi s$ signal of 100% controls operation of the fountain roll 20 over 90°. If the printing press operator decides that this would apply too much ink, the quantity can be reduced by setting the angle at a lower level, for example to rotate over only 85° during the time T/2.

Unit 45 receives a third signal, which is a ductor position signal, derived from the oscillating mechanism which controls the position of the ductor roller 21, e.g. a pulse, when the portion of the ductor cycle for engagement of the ductor roller with the fountain roll starts. This ductor position signal can be used as a START signal for unit 45, to start computing the output to be applied from unit 45 to an output junction J1, for connection to a servo amplifier 43, which controls and energizes the motor 40. The encoder or resolver signal, representative of speed of the fountain roll is coupled in a feedback loop to the electronic control unit 45.

The printing press system 1 of FIG. 1 is controlled by a programmable controller, as well known, which permits the press operator to control various machine functions, and monitor the operation of the machine. The operator establishes press speed and, also, the percentage of maximum ink transfer which the ductor roller 21 can transfer from the fountain roll 20. From press speed, the actual dwell time T/1 of the ductor roller 21 on the fountain roll 20 can be easily determined and calculated. The electronic control portion to control the fountain roll, in accordance with the present invention, requires two inputs: the ductor dwell time T/2 on the fountain roll, which, of course, is inversely proportional to press speed; and the desired angle of fountain roll advance, $\phi s$, as set by the operator. These signals, derived from operator command units 46 and 47, for press speed and dwell angle or, rather, fountain roll advance angle, respectively, are converted into 12-bit binary signals by means of the press programmable controller 45. The ductor position sensor 44 which, for example, is a Hall effect sensor, monitors the ductor position, or the operating element for the ductor, for example the cam, and provides a signal which is representative of the start of the ductor cycle. The encoder or resolver 42, which provides speed feedback for the fountain speed control loop, also provides a signal to the controller 45. This signal is integrated and provides a measurement of the actual angle of advancement, $\phi$, of the fountain roll 20 as it is rotated by the motor 40 through the gear box 41.

The ink fountain controller has a crystal control real-time clock which provides output pulses at the rate of 1 kilohertz, that is, one pulse per millisecond. The controller solves the following equation, once, each millisecond:

$$\text{speed reference} = k \cdot \frac{(\phi s - \phi)}{(T/2 - t)} \qquad (1)$$

wherein:

$(\phi s)-(\phi)$ is the remaining angle of rotation of the fountain roll 20 to be accomplished, $(T/2-t)$ is the remaining dwell time of the ductor roller 21 on the fountain roll 20 k is a constant of proportionality to provide the correct speed reference to the speed servo.

The term "speed reference"0 is indicative of the signal, before amplification, which is applied to the servo motor, to control the servo motor. It could also be termed a command speed for the servo motor, to be modified by the error signal fed back to the servo amplifier by the feedback loop from the encoder or resolver 42.

The servo motor 40 together with the gear box are commercial articles; high acceleration, low inertia units are commercially available. A typical fountain roll may have an inertia of 6.4"-lb-sec$^2$. The ductor roller inertia, for example, is 1.25"-lb-sec$^2$. At a press speed of 2500 ft/min., the ductor roller 21 will decelerate in approximately 60 milliseconds. Its deceleration torque is in the direction to aid acceleration of the fountain roll 20.

A motor-gear box combination can readily be assembled which is capable of bringing the fountain roll 20 to the required speed within 60 milliseconds. This takes maximum advantage of the kinetic energy of the ductor 21, which still rotates after engagement with the ink transfer roller 22. In addition to the inertial torque, the ink and blade 19 in engagement with the fountain roll 20 can exert a viscous torque thereon of up to 360"-lb. The gear box ratio is selected to approximately match the load inertia to that of the motor in order to achieve maximum energy transfer from the motor.

The system, to be described below, can account for all these factors. In actual practice, various motors-gear box combinations can be evaluated for required performance, based on commercial articles. The servo motor 40 should be a high-torque, low-inertia motor. Brushless a-c motors are preferred for maximum lifetime.

The peak motor torque required of the motor 40 during acceleration and deceleration can only be estimated. Many factors, such as the particular ink being used, temperature, adjustments by the press operator and the like, can affect the torque, and hence the speed-rise time achieved with the particular motor 40—gear box 41—fountain roll 20 combination. The system of FIG. 2 illustrates a suitable arrangement of motor - gear box combination with a control unit.

Figure 3:
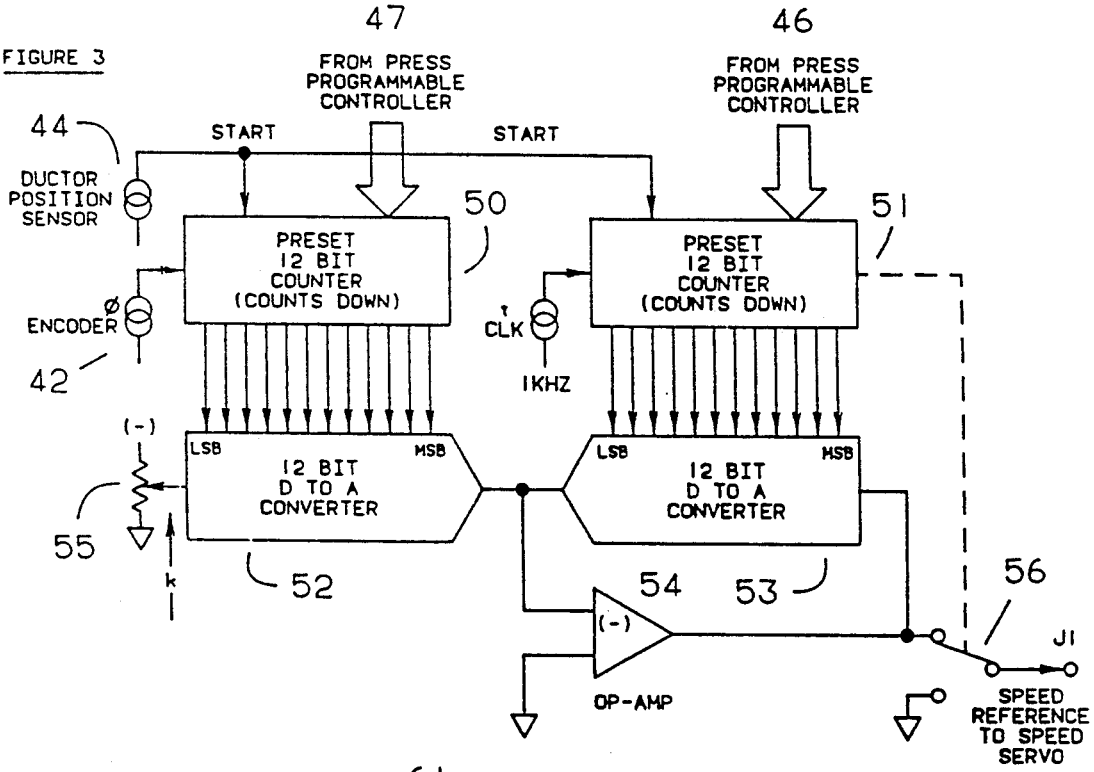
FIG. 3 is a schematic diagram illustrating details of the electronic programmable control unit.

The control unit and command inputs therefor is shown in greater detail in FIG. 3. Press speed and fountain roll advance angle are applied by input elements 46, 47, respectively, coupled to the press programmable controller 45. Unit 45 provides 12-bit signals, respectively. A 12-bit $\phi s$ advance signal is applied to a first counter 50, for example a 12-bit counter, to preset the counter to count down. The counter counts down under control of signals derived from the encoder or resolver 42. The count start is controlled by applying a START signal from the ductor position sensor 44. The count state is converted into an analog value, for example an analog voltage, in a 12-bit digital-to-analog (D/A) converter 52. A proportionality value k is applied to the D/A converter 52, as well known, for example by introducing a fixed voltage thereto from a voltage divider 55.

The START signal from the ductor position sensor 44 also starts counting in a second 12-bit counter 51. The second 12-bit counter 51 counts at the clock frequency of 1 kHz. It is preset to receive the 12-bit T/2 signal, that is, the signal representative of the time during which the ductor roller 21 is in contact with the fountain roll 20. The output from the down counter 51 is applied to a second digital-to-analog converter 53 which is connected in the feedback path of an operational amplifier 54, which, also, receives as an input the output from D/A converter 52. The output from the operational amplifier 54 is coupled to the junction J1, forming the speed reference signal for the servo amplifier 43 and hence for the servo motor 40.

Operation

At the beginning of the ductor cycle, as signaled by the START signal from the ductor position sensor, both counters 50, 51 are preset to the values of $\phi s$ and T/2, in accordance with the settings derived from the controllers 46, 47. At the same time, a solid-state switch 56 connects the output of operational amplifier 54 to the speed servo reference input. The output will be a step function reference equivalent to the speed required, provided the servo response were instantaneous.

As pulses are received from the encoder 42, the angle counter 50 counts down and contains a count, at any instant of time, which is equivalent to the remaining angle to be achieved—see the numerator in formula (1), above. Simultaneously, the 1 kHz clock signal causes the time counter 51 to count down, so that it will contain a count which is equivalent to the number of milliseconds remaining during the half ductor cycle, see the denominator of formula (1), above. These counts are converted to electrical signal levels or parameters by the D/A converters 52, 53 and connected, respectively, in the forward and feedback paths of operational amplifier 54. The operational amplifier 54 performs the division function and the output thereof, as calibrated by the k adjustment, is equivalent to the speed necessary to achieve the preset angle $\phi s$ at the end of the half ductor cycle time period T/2.

When the time counter reaches zero, signaling the end of the ductor roller 21 dwell time, the speed reference is switched by switch 56 to zero or ground reference, stopping motor 40.

The speed servo response is fast enough to reach a terminal speed within the time T/2. The control action ensures that the angle $\phi s$ will be achieved within, and at the time T/2.

The circuit can readily be constructed by using integrated circuits. Preferably, two channels are packaged together, each one on a printed circuit board, and each channel coupled to an individual one of the inkers.

For some operations, it is not necessary to always operate the fountain roll 20 intermittently. The intermittent operation, described hereinabove, causes stress on the servo motor 40, as well as on the gear box 41. In some operations, it may be desirable to run the fountain roll continuously for a given or predetermined number of ductor cycles and then produce one or more intermittent cycles, as required, to clear lint. This type of operation reduces the amount of motor heating and the amount of wear on the gear box 41.

Figure 4:
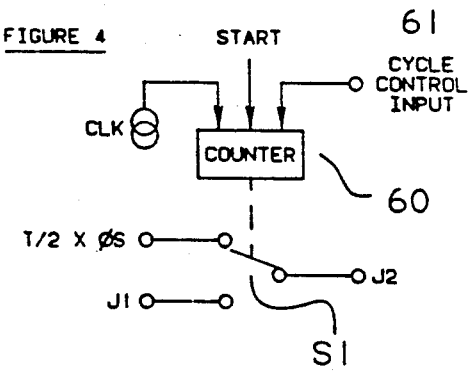
FIG. 4 is a fragmentary diagram of a modification of the system of FIG. 2 to permit selective continuous fountain roll rotation with interspersed intermittent roll rotation cycles.

FIG. 4 illustrates one way of so controlling the system.

A down counter 60 receives clock pulses, for example pulses at the rate of 1 kHz, ductor position signals from the ductor position sensor 44 and a signal from a cycle control input 61 representative of the number of cycles of the ductor roller 21 during which the fountain roll 20 is to rotate continuously before the intermittent cycle is initiated. The output from the control unit 45 is broken between junctions J1, J2 and, instead, a switch 57 is placed in the connection, controlled by the counter 60. The junction J2 can then be switched either to junction J1 or, selectively, to an input which is representative of press speed, for example an input representative of ductor dwell time T/2, as modified by the percentage of dwell angle, so that the speed of the fountain roll will be maintained continuously at a uniform level for the number of counts entered at the cycle control input. When that counter has counted down, or up to the number of preset cycles, the switch 61 switches, under control of counter 60, to the position in which the terminals J1, J2 are connected, thus initiating the intermittent cycle as described above. In a modification, the number of intermittent cycles can also be determined by the cycle control input. The START signal applied to the counter 60 provides the count signals for the cycles which are to be counted, either continuously rotating or intermittently.

Alternatively, the intermittent operation can be controlled by software within the press programmable control unit 45, e.g. by inhibiting switch 56 to switch to ground and instead initiating another count cycle by providing a simulated START signal to counters 50 and 51.

In one embodiment, the following components proved suitable Motor and gear box;

VICKERS FASA2-120-030 and MICRON SIZE 10 gear counters 50, 51: MOTOROLA MC14029B D/A converters 52, 53: ANALOG DEVICES AD75-41AKN;

the operational amplifier 54: any standard unit, for example: MOTOROLA MC1747P;

press programmable controller 45: ALLEN-BRADLEY PLC-3.

Various changes and modifications may be made, and any features described here in may be used with any of the others, within the scope of the inventive concept.

We claim:

1. Printing machine inker system, for controlling application of ink to a plate cylinder (10) of a printing machine (1), having an ink reservoir (18) for receiving printing ink;

a fountain roll (20) receiving ink from the ink reservoir;

an ink transfer roller (22);

ink train means (23-32) transferring ink from the ink transfer roller to said plate cylinder;

a ductor roller (21) and means (A) for cylically alternately engaging the ductor roller with said ink transfer roller (22) and with said fountain roll (20) during predetermined dwell time periods (T/2); and means for controllably intermittently driving said fountain roll, wherein said fountain roll drive means comprises, in accordance with the invention, a high torque servo motor (40) rotationally coupled to the fountain roll (20);

a sensor (44) coupled in sensing relation to the ductor roller (21) and providing a ductor position signal representative of a reference instant in a ductor roller cycle upon movement of the ductor roller (21) between the fountain roll (20) and the transfer roller (22); and a controller (45) controlling intermittent operation of the servo motor (40), said controller having first input means (46) receiving a signal representative of the duration of said dwell time periods (T/2);

second input means (47) receiving an operator controllable dwell angle signal ($\phi$S) representative of the angle of rotation of the fountain roller during which the ductor roller is in engagement with the fountain roller; and third input means receiving the ductor position signal (START), said programmable control unit (45) providing a control output (J1) for said servo motor (40) for controlling rotation of the servo motor to drive the fountain roll (20) over an angle as determined by said dwell angle signal (OS) during the dwell time period (T/2) of engagement of the ductor roller (21) with the fountain roll (20).

2. The system of claim 1 wherein said predetermined dwell time period (T/2) is a function of printing machine operating speed.

3. The system of claim 1, wherein said controller (45) includes computation means (54) for continuously, during engagement of the ductor roller (21) with the fountain roll (20), and defining a ductor roll cycle, carrying out the computation $$\text{control input} = k^{*}\frac{(\phi s - \phi)}{(T/2 - t)} \quad (1)$$

wherein:

($\phi$s)−($\phi$) is the remaining angle of rotation of the fountain roll 20 to be accomplished, (T/2−t) is the remaining dwell time of the ductor roller 21 on the fountain roll 20 k is a constant of proportionality.

4. The system of claim 3, wherein the computation means includes an operational amplifier (54) receiving said dwell angle signal and having a feedback connection from its output to its input, including means (53) connected in said feedback connection for applying the T/2−t signal thereto.

5. The system of claim 3, wherein said computation means provides an output (J1) forming a speed reference, coupled to said motor (40) for continuously controlling the servo motor during said ductor roll cycle to rotate at a speed such that the fountain roll (20) will turn through the selected dwell angle ($\phi$s) commanded by the dwell angle signal.

6. The system of claim 4, wherein said operational amplifier provides an output (J1) forming a speed reference, coupled to said motor (40) for continuously controlling the servo motor during said ductor roll cycle to rotate at a speed such that the fountain roll (20) will turn through the selected dwell angle ($\phi$s) commanded by the dwell angle signal.

7. The system of claim 3, further including means (56) for controlling said servo motor to stop at the termination of the ductor roll cycle.

8. The system of claim 4, wherein said computation means comprises counter means (50, 51) receiving said signal representative of dwell time (T/2), and said signal representative of dwell angle ($\phi$s);

clock means controlling said counter at a predetermined count rate; and means (52, 53) controlling the counter means for applying a signal representative of the count state, at any clock instant, for application in the feedback of said operational amplifier.

9. The system of claim 1, further including means (60) coupled to and counting the ductor position signals and, when the ductor position signals have reached a predetermined count level, controlling said control unit (45) to provide said control output (J1) to the servo motor.

10. The system of claim 9, including means (T/2·$\phi$s) controlling the servo motor for continuous rotation until the control unit (45) provides said control output.

11. A method of controlling the speed of operation of a fountain roll (20) of a printing press to rotate over a predetermined angle ($\phi$s) while engaging a cyclically operating ductor roller (21) during a predetermined dwell time (T/2) of the ductor roller with the fountain roll, comprising, in accordance with the invention, continuously, during each cycle of operation of the ductor roller (21), electronically solving the equation:

$$\text{fountain roll speed} = k^{*}\frac{(\phi s - \phi)}{(T/2 - t)} \quad (1)$$

wherein:

($\phi$s)−($\phi$) is the remaining angle of rotation of the fountain roll 20 to be accomplished, (T/2−t) is the remaining dwell time of the ductor roller 21 on the fountain roll 20 k is a constant of proportionality;

and continuously controlling the speed of rotation of the fountain roll (20) in accordance with the instantaneous value representative of the solution to said equation.

12. A method of controlling the operation of a fountain roll (20) of a printing machine, which fountain roll is cyclically engaged by a ductor roller (21), including the steps of counting the number of ductor roller cycles of operation;

and, after a predetermined count has been determined, controlling the operation of the fountain roll (20), as claimed in claim 11.

* * * * *